US005436413A

United States Patent [19]

Katakami

[11] Patent Number: 5,436,413

[45] Date of Patent: Jul. 25, 1995

[54] MULTIPLE STAGED ROTARY SWITCH

[75] Inventor: Seiki Katakami, Isesaki, Japan

[73] Assignee: Hosiden Corporation, Osaka, Japan

[21] Appl. No.: 123,088

[22] Filed: Sep. 17, 1993

[51] Int. Cl.[6] ..... H01H 19/58

[52] U.S. Cl. ..... 200/14; 200/11 DA; 200/6 R

[58] Field of Search ..... 200/4, 5 R, 6 R, 6 A, 200/11 R, 11 D, 11 DA, 11 J, 11 G, 14, 17 R, 18

[56] References Cited

U.S. PATENT DOCUMENTS

| | | | |
|---|---|---|---|
| 4,166,200 | 8/1979 | Reichen et al. | 200/11 R |
| 4,281,526 | 8/1981 | Lipschutz | 70/202 |
| 4,387,279 | 6/1983 | Brevick | 200/61.54 |

FOREIGN PATENT DOCUMENTS

| | | | |
|---|---|---|---|
| 685756 | 7/1930 | France | H01H 19/58 |
| 1341189 | 9/1963 | France | H01H 25/06 |
| 1819065 | 8/1960 | Germany | H01H 19/64 |
| 3336746 | 2/1984 | Germany | H01C 10/36 |
| 962098 | 6/1964 | United Kingdom . | |

OTHER PUBLICATIONS

"Rotary Switches", by T. Ormond, Electrical Design News, vol. 28, No. 1, Jan. 6, 1983, pp. 99–106.

*Primary Examiner*—A. D. Pellinen
*Assistant Examiner*—Michael A. Friedhofer
*Attorney, Agent, or Firm*—Pollock, VandeSande and Priddy

[57] ABSTRACT

A plurality of contacts for rotary switches are concentrically formed on a printed circuit board accommodated in a case. A fixed cylinder is disposed opposite to the concentric arrangement of the contacts. A rotary shaft of a first rotary knob pierces through and supports the fixed cylinder so as to drive slidable contact pieces for a first rotary switch. A rotary cylinder which functions as a rotary shaft of a second rotary knob is fitted to the outer periphery of the fixed cylinder so as to drive slidable contact pieces for a second rotary switch. Spring coils for the first and second rotary knobs are mounted on the fixed cylinder. The spring coils provide the first and second rotary knobs with tensions for their rotation reference positions. Thus, the positions of slidable contact pieces of the rotary switches are elastically maintained to their reference angle positions.

5 Claims, 7 Drawing Sheets

MULTIPLE STAGED ROTARY SWITCH

BACKGROUND OF THE INVENTION

The present invention relates to a multiple staged rotary switch for use in various controllers as in automobiles.

When the driver of a car controls a variety of apparatuses (such as an audio apparatus and an air conditioner) of the car, he or she should be able to fumble for and operate switches thereof without changing his or her eyes from the front. If the switches were of push button type, the driver could not easily fumble for them. In addition, while the driver is fumbling for such a switch, he or she may sometimes press incorrect switches.

On the other hand, when a multiple staged rotary switch is used, the driver can easily fumble for and correctly control it. Moreover, when the multiple staged rotary switch is used, it can be prevented from incorrectly being operated. In other words, unless the driver rotates the switch, it is never operated. Thus, in the multiple staged rotary switch, the possibility of unintended operations can be reduced. Therefore, the multiple staged rotary switches are being increasingly used.

FIG. 1 shows the construction of a conventional multiple staged rotary switch. In this switch, rotary switches 1, 2, and 3 are multiply staged. The rotary switches 1, 2, and 3 have drive shafts 6, 5, and 4, respectively. The drive shafts 4, 5, and 6 are concentrically formed. The more inner the shafts are the more they extend in the axial direction thereof. Knobs 7, 8, and 9 are mounted on end portions of the drive shafts 4, 5, and 6, respectively. With the knobs 7, 8, and 9, the rotary switches 1, 2, and 3 are operated, respectively.

Electric contact signals of the rotary switches 1, 2, and 3 are extracted from wiring boards 11, 12, and 13, respectively. The wiring boards 11, 12, and 13 are electrically connected to a main wiring board 14. The main wiring board 14 and the rotary switches 1, 2, and 3 are accommodated in a case 15. A lead cable 16 connected to the main wiring board 14 is connected to apparatuses to be controlled. Thus, the case 15 can be disposed at any position in the automobile corresponding to the length of the lead cable 16. For example, the case 15 may be disposed at a position where the driver can reach it with his or her hand.

As shown in FIG. 1, since the conventional multiple staged rotary switch is constructed of the rotary switches 1, 2, and 3 which are staged, the thickness H of the case 15 becomes large. In this multiple staged rotary switch, when the driver turns the knob 7, 8, or 9 clockwise or counterclockwise and then releases it, it is automatically returned to its rotation reference position (home angle position) by the tension of a spring coil thereof. When a knob is turned clockwise or counterclockwise by a predetermined angle (for example, 20°) from a predetermined rotation reference position, a contact signal is generated. Whenever the contact signal is generated, the state of the apparatus to be controlled is changed by one step in the plus or minus direction. For example, when the knob 9 is turned by the predetermined angle from the rotation reference position clockwise, one contact signal is generated. The contact signal causes the sound volume of for example an audio apparatus to be varied by one step in the plus direction. When this operation is repeated, the sound volume increases. In contrast, when the knob 9 is rotated by the predetermined angle counterclockwise, another contact signal is generated. This contact signal causes the sound volume of the audio apparatus to be varied by one step in the minus direction. When this operation is repeated, the sound volume decreases.

Since the rotary switches 1, 2, and 3 are provided with respective spring coils which produce tensions, the thickness T of the rotary switches 1, 2, 3 becomes comparatively large. This too, means that the thickness H of the case 15 must be large.

SUMMARY OF THE INVENTION

An object of the present invention is to provide a multiple staged rotary switch accommodated in a small height case.

According to the present invention, a plurality of concentric switch contacts are formed on a printed circuit board. On the printed circuit board, a plurality of rotary switches are formed so as to reduce the thickness of a case. The case supports concentric multiple rotary shafts. The concentric multiple rotary shafts cause slidable contact pieces to be circularly slid on the switch contacts. A fixed cylinder is provided which comes in contact with at least one cylindrical surface of the concentric multiple rotary shafts. The fixed cylinder is provided with spring coils which apply restoring forces to the uppermost knob and the next knob. Thus, according to the present invention, the knobs are provided with respective spring coils so as to reduce the thickness of the case.

These and other objects, features and advantages of the present invention will become more apparent in light of the following detailed description of a best mode embodiment thereof, as illustrated in the accompanying drawings.

DESCRIPTION OF THE PREFERRED EMBODIMENT

Figure 1:
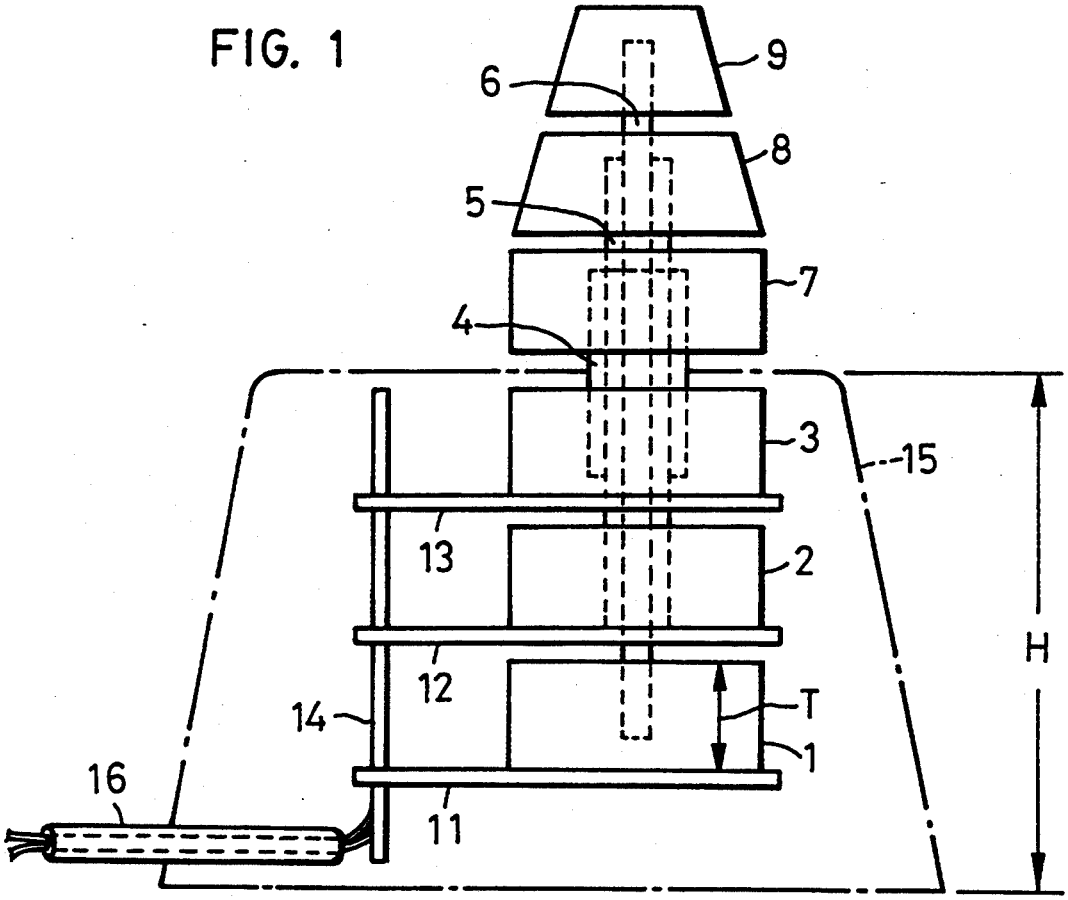
FIG. 1 is a sectional view for explaining a related art reference.
Figure 2:
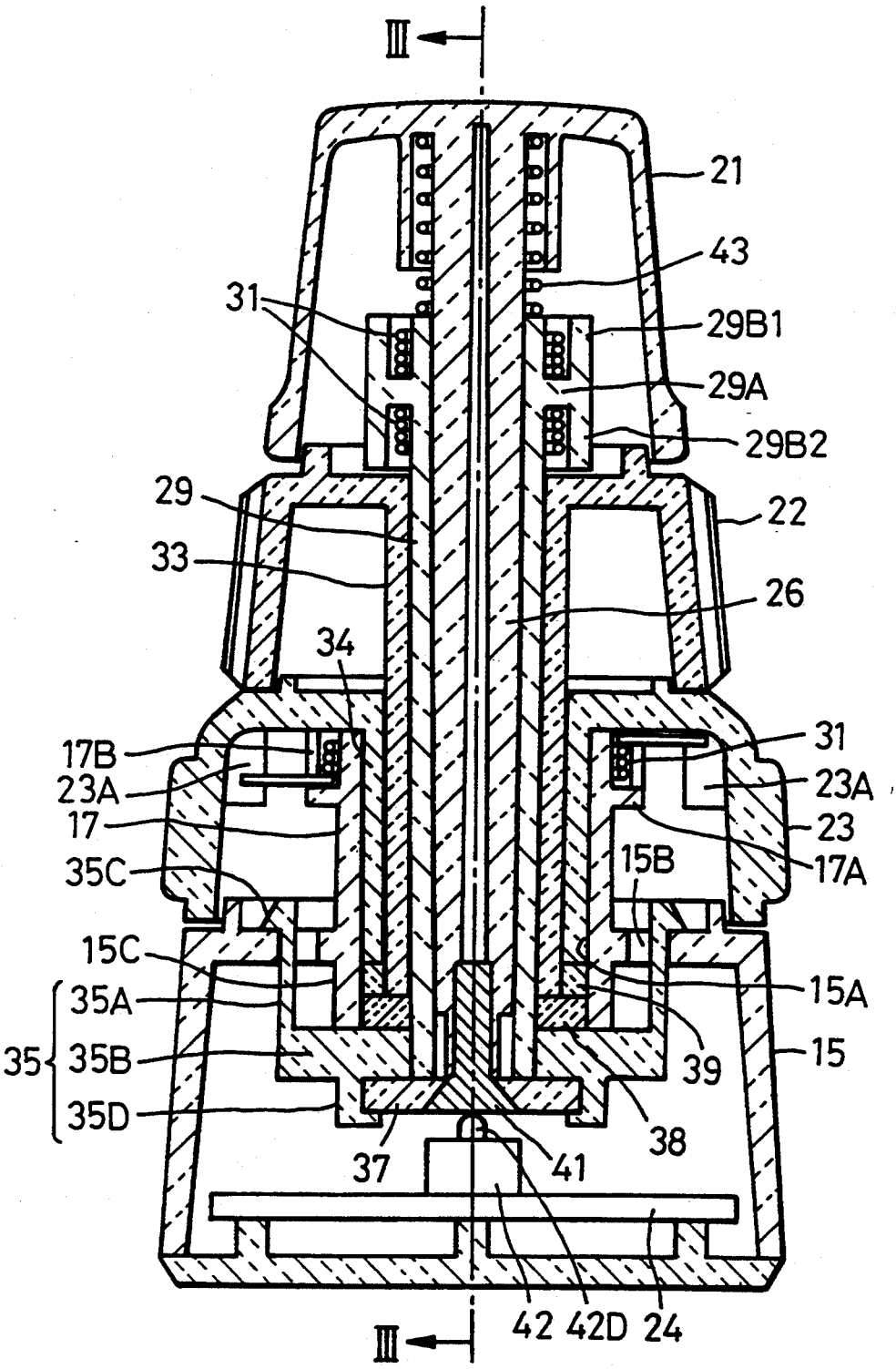
FIG. 2 is a longitudinal sectional view showing an embodiment of the present invention.
Figure 3:
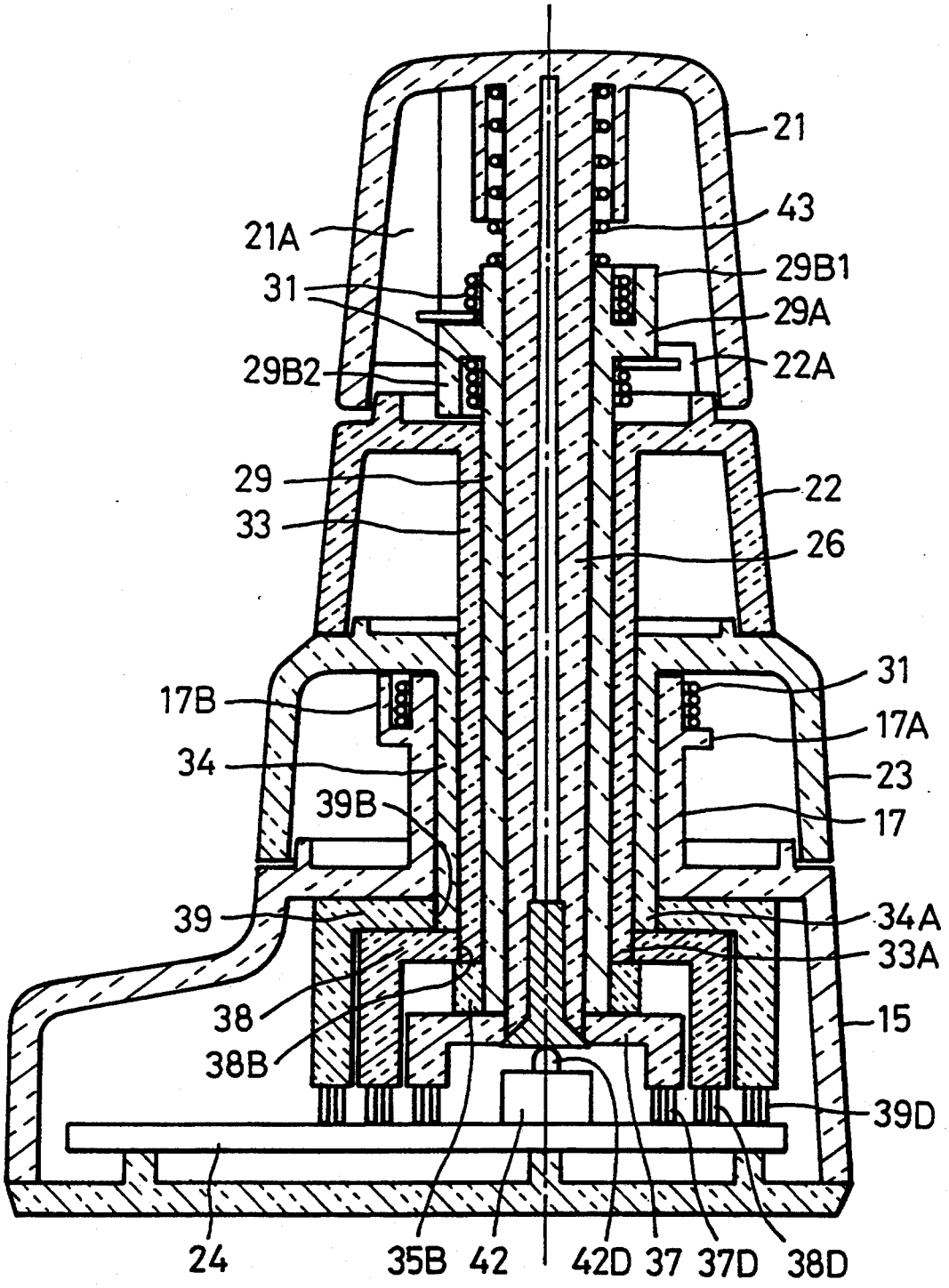
FIG. 3 is a sectional view taken along line III—III of FIG. 2.
Figure 4:
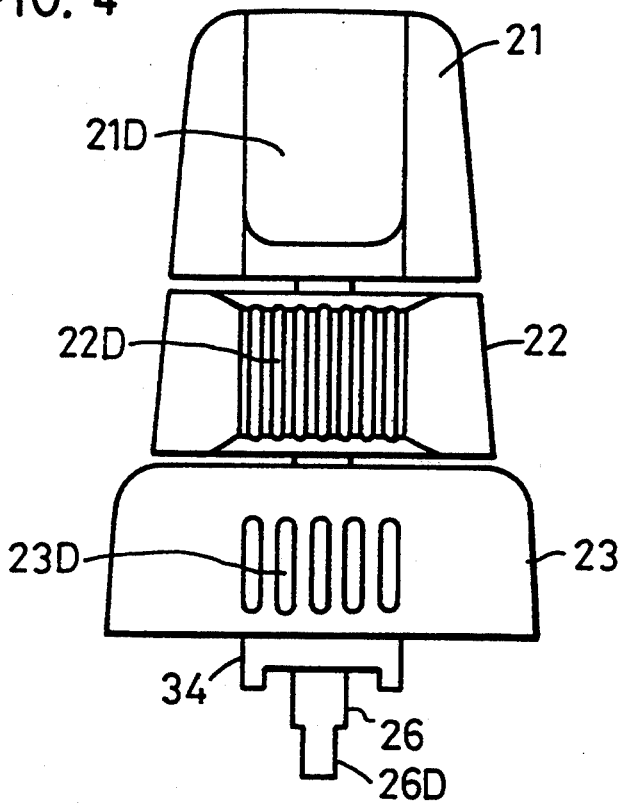
FIG. 4 is a side view showing an example of three-staged rotary knobs according to the embodiment of the present invention.

FIGS. 2 and 3 are longitudinal sectional views of a multiple staged rotary switch according to an embodiment of the present invention. The view of FIG. 2 is perpendicular to the view of FIG. 3. In these figures, reference numeral 15 is a case. At the top of the case 15, a first rotary knob 21, a second rotary knob 22, and a third rotary knob 23 are disposed. These rotary knobs 21, 22, and 23 are rotatably supported by the case 15. The rotary knobs 21, 22, and 23 have differently embossed peripheral surfaces 21D, 22D, and 23D, respectively, as shown in FIG. 4.

Figure 5:
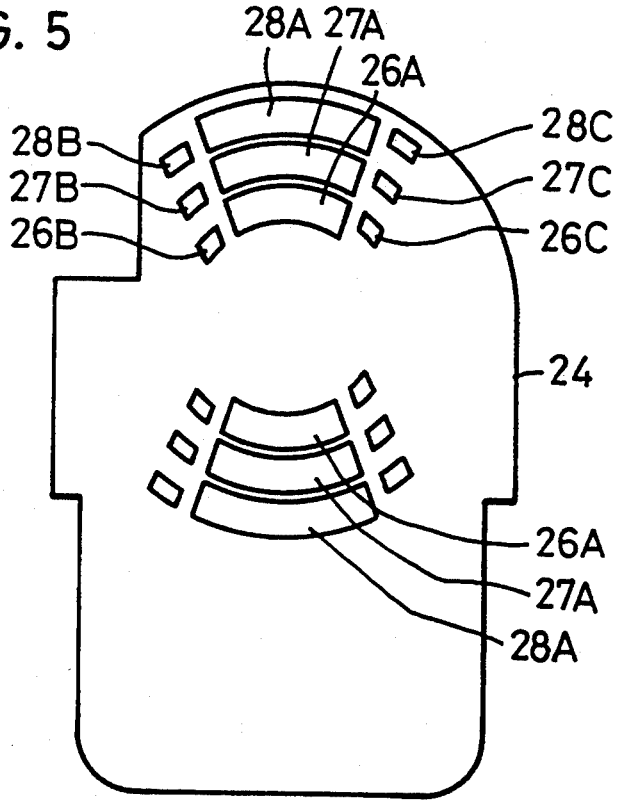
FIG. 5 is a plan view for explaining an example of the arrangement of a plurality of sets of rotary switch contacts formed on a printed circuit board according to the embodiment of the present invention.
Figure 6:
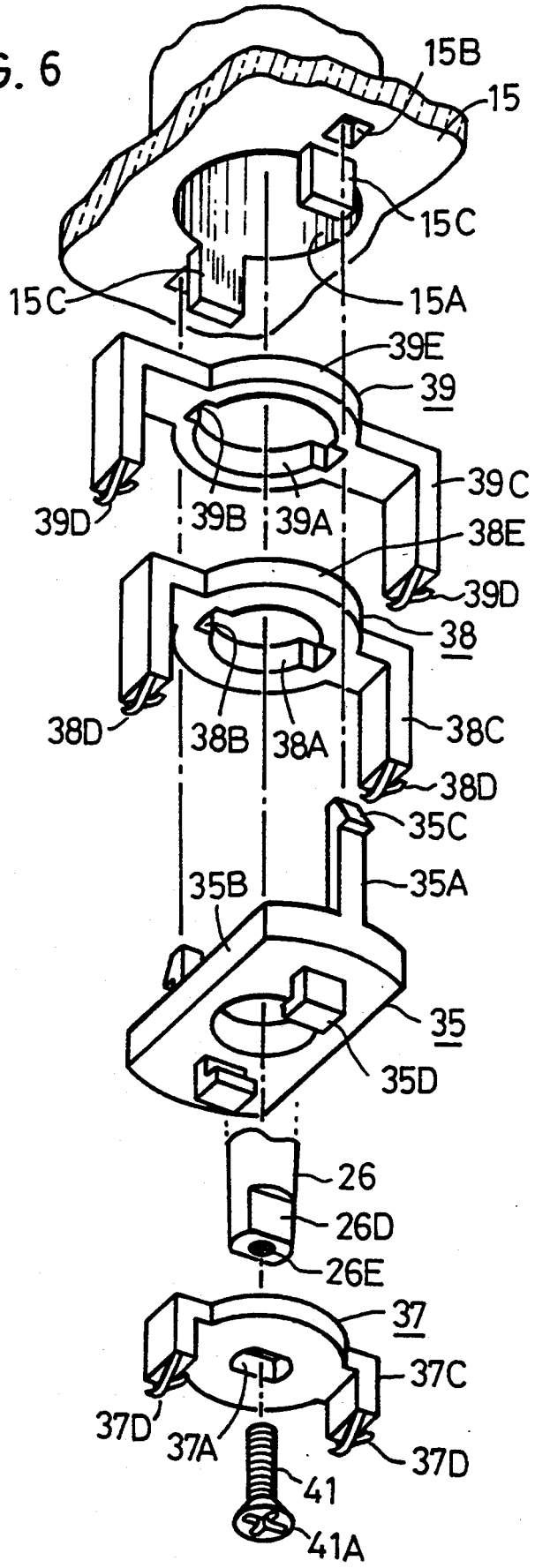
FIG. 6 is an exploded perspective view for explaining an assembly of three slidable member support plates and a support member according to the embodiment of the present invention.

A feature of the present invention is as follows. One printed circuit board 24 is disposed in the case 15. As shown in FIG. 5, a plurality of switch contacts (26A, 26B, and 26C), (27A, 27B, and 27C), and (28A, 28B, and 28C) are concentrically and peripherally disposed on the upper surface of the printed circuit board 24. These switch contacts (26A, 26B, and 26C), (27A, 27B, and 27C), and (28A, 28B, and 28C) cooperate with a plurality of resilient slidable contact pieces 37D, 38D, 39D of the rotary switches on the same plane as shown in FIGS. 3 and 6. A fixed cylinder 29 is disposed opposite to the axial centers of the switch contacts (26A, 26B, and 26C), (27A, 27B, and 27C), and (28A, 28B, and 28C). The fixed cylinder 29 provides the first rotary knob 21 and the second rotary knob 22 with their rotation reference points.

The fixed cylinder 29 supports two spring coils 31. The spring coils 31 apply tensions to both the first rotary knob 21 and the second rotary knob 22. Thus, even if the first rotary knob 21 or the second rotary knob 22 is turned clockwise or counterclockwise, when the rotated knob is released, it is automatically returned to its reference angle position.

According to the present invention, the plurality of switch contacts (26A, 26B, and 26C), (27A, 27B, and 27C), and (28A, 28B, and 28C) which are concentric circles with different diameters are formed on the one printed circuit board 24. In addition, the plurality of springs which provide the rotary switches with restoring forces are disposed within the rotary knobs. Thus, the thickness of the case 15 can be reduced and thereby the overall size of the multiple staged rotary switch can be reduced.

Next, the construction of each portion of the multiple staged rotary switch will be described. An opening 15A is defined in a ceiling plate of the case 15. The opening 15A is concentrically disposed opposite to the switch contacts (26A, 26B, and 26C), (27A, 27B, and 27C), and (28A, 28B, and 28C) shown in FIG. 5. On the periphery of the opening 15A, a cylindrical boss 17 is formed as a second fixed cylinder. The cylindrical boss 17 extends upwardly. Inside the second fixed cylinder 17, rotary cylinders 33 and 34 are concentrically disposed. The rotary cylinders 33 and 34 are formed integrally along with the second rotary knob 22 and the third rotary knob 23, respectively. Inside the rotary cylinder 33, the first fixed cylinder 29 is disposed. In this example, the first fixed cylinder 29 is supported and fixed by a support member 35 which is located inside the case 15.

As shown in FIGS. 2 and 6, the support member 35 is composed of a base plate 35B and U-letter shaped arms 35A. The U-letter shaped arms 35A are disposed at both ends of the case plate 35B. At a free end of each of the arms 35A, a hook 35C is formed. The hook 35C fits to a hole 15B defined in the case 15. Ring shaped slidable contact support disks 38 and 39 are rotatably supported between the base plate 35B and the ceiling plate of the case 15. The base plate 35B of the support member 35 comes into abutment with a pair of legs 15C which extend from the peripheral portion of the opening 15A of the case 15 on the inside thereof. In this way, the base plate 35B is positioned. A pair of L-letter shaped fitting lugs 35D which are opposed each other are formed on the lower surface of the base plate 35B of the support member 35. A first slidable contact support disk 37 is rotatably supported between the fitting lugs 35D and the base plate 35B. The first slidable contact support disk 37 is rotated by the first rotary knob 21. The first rotary knob 21 and a shaft 26 are integrally formed. The shaft 26 penetrates through the base plate 35B of the support member 35 via a through-hole of the fixed cylinder 29. At an end of the shaft 26, a flat cylindrical portion 26D is formed. Both sides of the flat cylindrical portion 26D axially extend along the shaft 26. The flat cylindrical portion 26D slidable pierces through a flat circular hole 37A defined in the first slidable contact support disk 37. Thus, the first slidable contact support disk 37 is rotated by the first rotary knob 21.

A screw 41 is inserted into and secured to a screw hole 26E defined at the lower end of the flat cylindrical portion 26D of the shaft 26E through the flat circular hole 37A of the first slidable contact support disk 37. A head 41A of the screw 41 prevents the first slidable contact support disk 37 from coming off, thereby preventing the first rotary knob 21 from coming off, and eventually also preventing the second and third rotary knobs 22 and 23 from coming off. The first slidable contact support disk 37 has two diametrically opposed peripheral portions extending radially outwardly. The extended portions are bent downwardly at the intermediate portions thereof, thereby forming leg portions 37C which are opposed to each other and extend in parallel.

The ring shaped second and third slidable contact support disks 38 and 39 fit to the lower end portions of the rotary cylinders 33 and 34, respectively. The inner diameters of the second and third slidable contact support disks 38 and 39 have ring portions 38E and 39E, respectively. The inner diameters of the ring portions 38E and 39E are the same as the inner diameters of the cylinders 33 and 34, respectively. The outer diameters of the ring portions 38E and 39E are nearly the same. The fixed cylinder 29 and the rotary cylinder 33 penetrate through the holes 38A and 39A of the ring portions 38E and 39E, respectively. The ring portion 38E has two diametrically opposed outer peripheral portions extending radially outwardly. The extended portions are bent downwardly at the intermediate portions thereof, thereby forming leg portions 38C which are opposed to each other and extend in parallel. Likewise, two diametrically opposed outer peripheral portions of the ring shaped portion 39E extend outwardly. The extended peripheral portions are bent downwardly at the intermediate portions thereof, thereby forming leg portions 39C which are opposed to each other and extend in parallel. At inner peripheral portions of the ring portion 38E which are adjacent the legs 38C, notches 38B are defined. Likewise, at inner peripheral portions of the ring portion 39E which are adjacent the legs 39C, notches 39B are defined. The notches 38B and 39B fit to protrusions 33A and 34A which protrude from the cylinders 33 and 34 which are in contact with the ring portions 38E and 39E, respectively. By rotating the shafts 33 and 34, the support disks 38 and 39 can be rotated, respectively. The base plate 35B of the support member 35 extends in the direction perpendicular to the longitudinal directions of the ring portions 38E and 39E. The arms 35A of the support members 35 limit the maximum angles of the rotations of the second and third slidable contact support disks 38 and 39. Thus, the arms 35A function as stoppers. On the other hand, the rotation of the first slidable contact support disk 37 is limited by the L-shaped fitting lugs 35D formed on the rear surface of the support member 35.

Figure 6A:
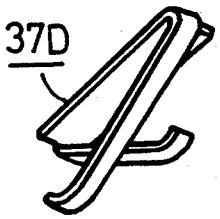
FIG. 6A is an enlarged view showing the slidable member.

As representatively shown in FIG. 6A, at the lower ends of the leg portions 37C of the slidable contact support disk 37, slidable contact pairs 37D are mounted. Each of the slidable contact pairs 37D has two contact pieces which are integrally formed and extend to cross each other. The slidable contact pair 37D is in slidable contact with the switch contacts 26A, 26B, and 26C which are disposed on the innermost periphery of the printed circuit board 24. Similar contact pairs are provided on the slidable contact support disks 38 and 39. Thus, the slidable contact pair 38D is in slidable contact with the switch contacts 27A, 27B, and 27C. The slidable contact pair 39D is in slidable contact with the switch contacts 28A, 28B, and 28C. Consequently, the slidable contact pair 37D causes the switch contact 28A to come in contact with the switch contact 26B or 26C. The slidable contact pair 38D causes the switch contact 27A to come in contact with the switch contact 27B or 27C. The slidable contact pair 39D causes the switch contact 28A to come in contact with the switch contact 28B or 28C. As a result, respective contact signals are generated. In the case where the return positions of the slidable contact pairs 37D, 38D, and 39D are designated at nearly center positions of the switch contacts 26A, 27A, and 28A, respectively, when the rotary knobs 21, 22, and 23 are rotated equally clockwise and counterclockwise, respective contact signals are generated.

The rotary knobs 21, 22, and 23 each have two inner protrusions (see FIGS. 2, 3, 7A, 7B). Each protrusion defines two engagement surfaces. The inner protrusions of the rotary knobs 21, 22, and 23 are denoted by 21A, 22A, and 23A, respectively. The engagement surfaces of the protrusions 21A, 22A, and 23A are denoted by 21B, 22B, and 23B, respectively. The engagement surfaces 21B, 22B, and 23B elastically engage both of the free ends of the spring coils 31 wound around the fixed cylinders 29 and 17. Thus, the fixed cylinders 29 and 17 are back-tensioned. In addition, intermediate portions of the free ends of the coils 31 elastically engage banks 29B1, 29B2 and 17B which are integrally formed on the fixed cylinders 29 and 17, respectively. Thus, the fixed cylinders 29 and 17 are further back-tensioned.

Figure 7A:
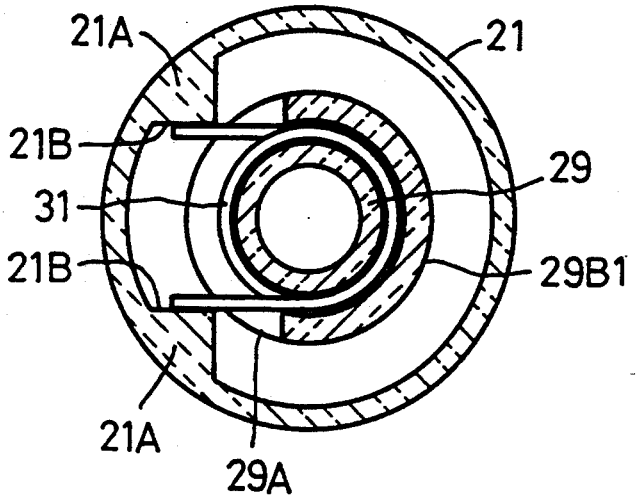
FIG. 7A is a sectional view for explaining the relation between a rotary knob 21 and a spring coil according to the embodiment of the present invention.

FIG. 7A is a lateral sectional view of the first rotary knob 21. On the fixed cylinder 29, a flange portion 29A and two semi-circular banks 29B1, 29B2 (see FIGS. 2 and 3) are irrtegrally formed, which support the spring coils 31. The semi-circular banks 29B1 and 29B2 extend from the outer periphery of the flange portions 29A in axially opposite directions of the fixed cylinder 29. Both side ends of each of the banks 29B1, 29B2 elastically engage with the intermediate portions of both the free ends of the corresponding-spring coil 31. In other words, both free ends of the spring coil 31 are elastically deformed so that they apply a tension to both of the side ends of the corresponding bank. Both free ends of the spring coil 31 are elastically engaged with the engagement surfaces 21B of the protrusions 21A formed in the rotary knob 21, thereby applying a tension of the spring coil 31 to the rotary knob 21.

Figure 7B:
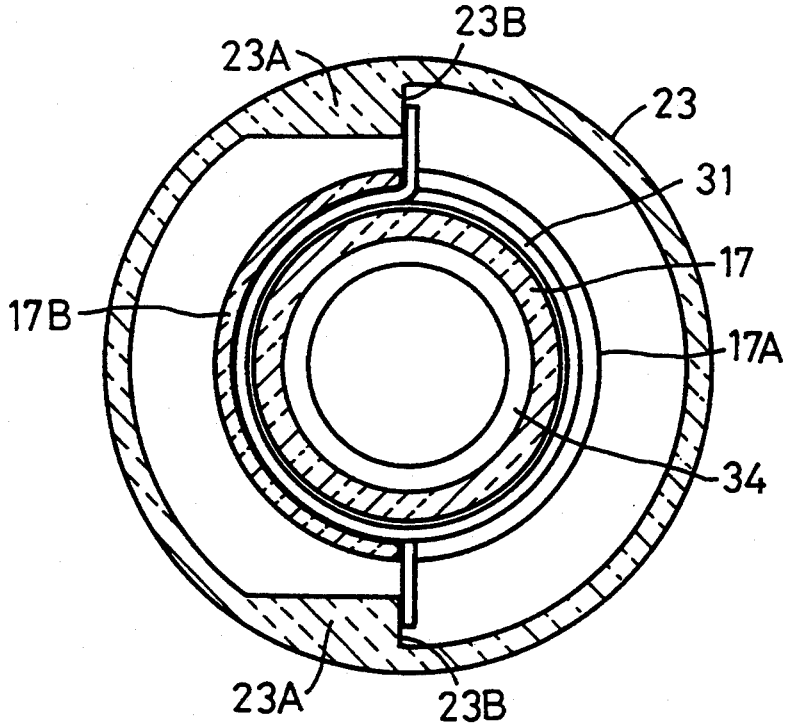
FIG. 7B is a sectional view for explaining the relation between a rotary knob 23 and a spring coil according to the embodiment of the present invention.

When the rotary knob 21 is rotated clockwise in the condition shown in FIG. 7A, one free end of the spring coil 31 is turned by the engagement surface 21B. At this time, since the other free end of the spring coil 31 abuts one side end of the bank 29B1, the spring coil 31 is wound and thereby a restoring force is stored therein. When the first rotary knob 21 is released, it is returned back to the normal position. When the first rotary knob 21 is rotated counterclockwise, the spring coil 31 stores a restoring force in the same manner. Thus, when the first rotary knob 21 is released, it is returned to the normal position. The second rotary knob 22 has the two inner protrusions 22A (only one is seen in FIG. 3) which protrude into an inner space of the first rotary knob 21 from the rear thereof. The corresponding spring coil 31 is mounted on the fixed cylinder 29. As with the relation shown in FIG. 7A, the free ends of the spring coil 31 are elastically engaged with the engagement surfaces 22B. As shown in FIG. 7B, the third rotary knob 23 has similar two inner protrusions 23A which protrude from the inner periphery thereof. The spring coil 31 is supported by a flange 17A formed on the outer periphery of the fixed cylinder 17. Intermediate portions of the free ends of the spring 31 elastically engage with the side ends of the bank 17B which extends in the axial direction of the fixed cylinder 17. In addition, the free ends of the spring 31 elastically engage with the engagement surfaces 23B of the protrusions 23A. In the example shown in FIG. 7B, although the free ends of the spring coil 31 extend in opposite directions the principle of operation of this example is the same as that of FIG. 7A.

In the embodiment shown in FIGS. 2 and 3, a push button switch 42 may be disposed opposite to the lower end of the shaft 26. Whenever the first rotary knob 21 is pressed, an actuator 42D of the push button switch 42 is pressed by the head of a screw 41, thereby turning on or off the push button switch 42. In this example, a restoring spring coil 43 is disposed around the shaft 26 between the inner wall of the first rotary knob 21 and the front end (top end in FIGS. 2 and 3) surface of the fixed cylinder 29. The first rotary knob 21 can axially move until its rear end comes in contact with the front surface of the second rotary knob 22.

In the above-described embodiment, the third rotary knob 23 was used. However, the feature of the present invention is that the fixed cylinder 29 provides the first and second rotary knobs with their rotation reference positions. Thus, the third rotary knob 23 is not always an essential member of the present invention. Therefore, the third rotary knob 23 may be provided corresponding to the control requirements of an apparatus to be used. In the situation where the control requirements of the apparatus to be used exceed three items, by providing a plurality of fixed cylinders, rotary knobs whose rotation reference points are provided by the case 15 may be increased. Thus, a multiple staged rotary switch which can control various operations can be provided.

Figure 8:
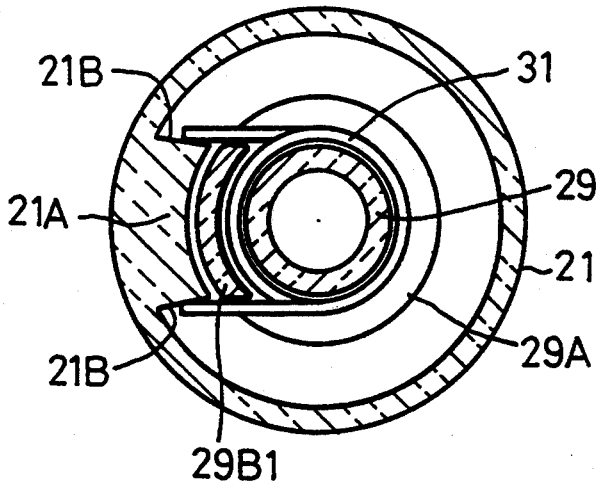
FIG. 8 is a sectional view showing another example of the relation between a rotary knob and a spring coil.
Figure 9:
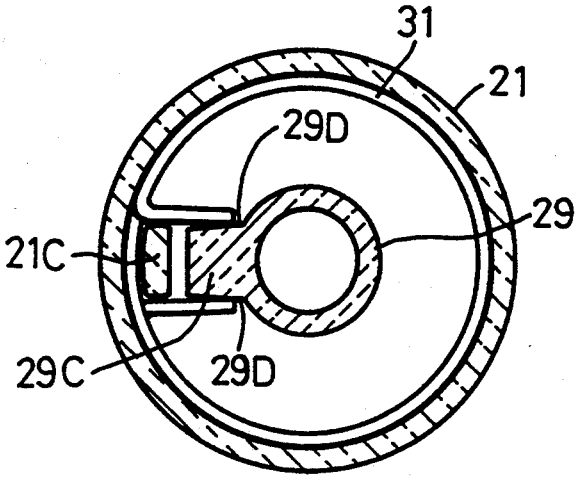
FIG. 9 is a sectional view showing a further example of the relation between a rotary knob and a spring coil.

In the above-described embodiment, as shown in FIGS. 2, 3, 7A, and 7B, the two engagement surfaces 21B (23B) which are engaged by the free ends of the spring coils 31 were formed on the protrusions 21A (23A). However, as shown in FIG. 8, which representatively shows a lateral section of the rotary knob 21, two engagement surfaces 21B may be defined on the protrusion 21A formed on the inner wall of the rotary knob 21. In the above-described embodiment, the spring coils 31 were wound around the fixed cylinders 29 and 17. However, as shown in FIG. 9, which representatively shows a lateral section of the rotating knob 21, a spring coil 31 which has two free ends which are bent inwardly may be mounted on the inner periphery of the rotary knob 21. Intermediate portions of the free ends of the spring coil 31 may be engaged with a bank 21C which extrudes from the front wall of the rotary knob 21. In addition, a protrusion 29C which defines two engagement surfaces 29D on the outer periphery of the fixed cylinder 29 may be formed.

As was described above, according to the present invention, a plurality of rotary switch contacts (26A, 26B, and 26C), (27A, 27B, and 27C), and (28A, 28B, and 28C) are formed on one printed circuit board 24. A plurality of rotary switches are formed to engage that printed circuit board 24. Thus, the thickness of a case 15 can be reduced. In addition, spring coils 31 which apply tensions are disposed at respective positions of rotary knobs 21, 22, and 23. Thus, the space for the spring coils 31 can be reduced. Consequently, a multiple staged rotary switch which is easy-to-use and whose overall size is reduced can be provided.

Although the present invention has been shown and described with respect to a best mode embodiment thereof, it should be understood by those skilled in the art that the foregoing and various other changes, omissions, and additions in the form and detail thereof may be made therein without departing from the spirit and scope of the present invention.

What is claimed is:

1. A multiple staged rotary switch, comprising:

a plurality of sets of switch contacts concentrically disposed on one surface of a printed circuit board;

a case for accommodating and supporting said printed circuit board and defining an opening opposite to the center of said switch contacts;

a fixed cylinder defining an axial through-hole and extending from said case through said opening;

a rotary shaft piercing through the through-hole of said fixed cylinder and having a first rotary knob disposed at one end thereof outside said case;

a first slidable contact support means disposed at the other end of said rotary shaft in opposing relation to said one surface of said printed circuit board inside said case and adapted to support first slidable contact means, said first slidable contact means being adapted to be in and out of electrical contact with a first set of said switch contacts on said one surface of said printed circuit board;

a rotary cylinder rotatably fitted to the outer periphery of said fixed cylinder;

a second rotary knob mounted at one end of said rotating cylinder outside said case;

a second slidable contact support means disposed at the other end of said rotary cylinder inside said case and adapted to support second slidable contact means, said second slidable contact means being adapted to be in and out of electrical contact with a second set of said switch contacts on said one surface of said printed circuit board;

first spring coil means disposed between said fixed cylinder and said first rotary know and adapted to apply a tension to said first rotary knob so as to return said first rotary knob to a predetermined rotation reference position; and second spring coil means disposed between said fixed cylinder and said second rotary knob and adapted to apply a tension to said second rotary knob so as to return said second rotary knob to a predetermined rotation reference position.

2. The multiple staged rotary switch as set forth in claim 1, further comprising:

a second rotary cylinder extending through said opening and having an axial hole through which said first rotary cylinder pierces and having a third rotary knob disposed at one end thereof outside said case;

a third slidable contact support means disposed at the other end of said second rotary cylinder in opposing relation to said one surface of said printed circuit board inside said case to support third slidable contact means;

said third slidable contact means being disposed on said third slidable contact support means and adapted to be in and out of electrical contact with a third set of said switch contacts on said one surface of said printed circuit board so as to form a third rotary switch; and third spring coil means disposed between said case and said third rotary knob and adapted to apply a tension to said third rotary knob so as to :return said third rotary knob to a predetermined rotation reference position.

3. The multiple staged rotary switch as set forth in claim 1 or 2, wherein said first spring coil means is disposed inside said first rotary knob.

4. The multiple staged rotary switch as set forth in claim 2, wherein a second fixed cylinder is formed integrally with said case to extend axially around an outer surface of said second rotary cylinder from an inner circumference of said opening, and wherein said third spring coil means is disposed inside said third rotary knob.

5. The multiple staged rotary switch as set forth in claim 1 or 2, wherein the rotating shaft of said first rotary knob is axially slidably fitted to said first slidable contact support means, and wherein a push button switch is disposed on said printed circuit board opposite to an end of said rotary shaft, said rotary shaft being adapted to turn on or off said push button switch.

* * * * *